US012630264B2

(12) United States Patent
L'Heureux et al.

(10) Patent No.: US 12,630,264 B2
(45) Date of Patent: May 19, 2026

(54) CLEAT ADAPTER CONFIGURED FOR CONNECTING TO A U-SHAPED TOW EYE

(71) Applicant: BOMBARDIER RECREATIONAL PRODUCTS INC., Valcourt (CA)

(72) Inventors: Marc-Andre L'Heureux, Bromont (CA); Abdelkarim Meskine, Valcourt (CA); Bart Van Den Bogaard, Racine (CA); Austin Anton, Bromont (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 301 days.

(21) Appl. No.: 18/493,493

(22) Filed: Oct. 24, 2023

(65) Prior Publication Data

US 2025/0128789 A1 Apr. 24, 2025

(51) Int. Cl.
*B63B 21/04* (2006.01)

(52) U.S. Cl.
CPC ..... *B63B 21/04* (2013.01)

(58) Field of Classification Search
CPC ..... B63B 21/04
See application file for complete search history.

(56) References Cited

U.S. PATENT DOCUMENTS 4,685,500 A * 8/1987 Silvia ..... B63B 21/045 206/525
6,769,375 B1 * 8/2004 Caporella ..... B63B 21/045 248/74.5
7,025,012 B1 * 4/2006 Pecharich ..... B63B 21/045 248/74.5
2017/0144730 A1 * 5/2017 Miller ..... B63B 71/00
2018/0009510 A1 * 1/2018 Arote ..... B63B 21/045

OTHER PUBLICATIONS

SEA-MY24-SPECBOOK-1-PWC-ACC-DIGITAL-A4-ENAU Available at https://sea-doo.brp.com/content/dam/global/en/sea-doo/my24/documents/brochures/SEA-MY24-SPECBOOK-1-PWC-ACC-DIGITAL-A4-ENAU.pdf (Year: 2024).*

* cited by examiner

*Primary Examiner* — Evan P Dzierzynski
(74) *Attorney, Agent, or Firm* — BCF LLP

(57) ABSTRACT

A cleat adapter connectable to a U-shaped tow eye includes a first portion and a second portion connected to the first portion that define an adapter body. The adapter body defines a passage to receive and capture a portion of the U-shaped tow eye. The adapter body includes: a first member, a second member, and an arm extending therebetween. The first member, the second member and the arm together defining a generally U shape and a space for receiving a tow cord. The adapter body further includes a first protrusion for retaining a first portion of the tow cord and a second protrusion for retaining a second portion of the tow cord. The first protrusion extending laterally outward from the first member and the second protrusion extending laterally outward from the second member. A watercraft having a cleat adapter and a method for attaching the cleat adapter are also disclosed.

20 Claims, 15 Drawing Sheets

CLEAT ADAPTER CONFIGURED FOR CONNECTING TO A U-SHAPED TOW EYE

FIELD OF TECHNOLOGY

The present application relates to cleat adapters configured for connecting to U-shaped tow eyes and to watercraft provided with such cleat adapters.

BACKGROUND

Personal watercraft are often provided with a tow eye attached to the rear of the vessel for towing a skier, wakeboarder, inflatable accessory, or another stranded vehicle. Conventional tow eyes are typically formed in a U shape and are mounted to the rear of the pedestal below the seat of the watercraft or at the rear of the reboarding platform. A tow cord is used to tow the skier, wakeboarder, inflatable accessory, or stranded vehicle. The tow cord includes a loop at either end, one loop being secured to the tow eye and the other being attached to the towed object.

When securing the tow cord to the tow eye, the loop at the first end of the cord is passed through an aperture formed by the U-shaped tow eye and a surface of the watercraft. The second end of the tow cord is passed through the loop of the first end and the cord is pulled tight around the tow eye. Although this provides a secure attachment, tow cords can be anywhere between 45 to 70 feet long and, as a result, threading the second end through the loop of the first end can be time consuming.

In some instances, a J-hook is installed (either in addition to or in place of the U-shaped tow eye) as an attachment point for the tow cord. However, installation of the J-hook requires removing the original U-shaped tow eye from the watercraft. The components which fix J-hook and the U-shaped tow eye to the deck are in the engine compartment which is difficult to access.

In view of the foregoing, there is a desire for an alternative to provide users with an easy to install attachment for securing a tow cord on a watercraft.

SUMMARY

It is an object of the present technology to ameliorate at least some of the inconveniences present in the prior art.

According to one aspect of the present technology, a cleat adapter connectable to a U-shaped tow eye. The cleat adapter includes a first portion and a second portion connected to the first portion, the first portion and the second portion together defining an adapter body. The adapter body defining a passage configured to receive a portion of the U-shaped tow eye and to capture the portion of the U-shaped tow eye in the adapter body. The adapter body includes: a first member, a second member, and an arm extending between the first member and the second member. The first member, the second member and the arm together defining a generally U shape. The first member, the second member and the arm together defining a space for receiving a tow cord. The adapter body further includes a first protrusion for retaining a first portion of the tow cord and a second protrusion for retaining a second portion of the tow cord. The first protrusion extending laterally outward from the first member and the second protrusion extending laterally outward from the second member.

In some embodiments, the passage has a first passage portion defined in the first member for receiving a first straight portion of the U-shaped tow eye. A second passage portion defined in the second member for receiving a second straight portion of the U-shaped tow eye. A curved passage portion defined by the arm for receiving a curved portion of the U-shaped tow eye. The curved passage portion extending between the first passage portion and the second passage portion. The curved portion of the U-shaped tow eye extending between the first straight portion of the U-shaped tow eye and the second straight portion of the U-shaped tow eye.

In some embodiments, the first portion is an upper portion having: an upper first member, an upper second member, an upper arm, an upper first protrusion, and an upper second protrusion. The second portion is a lower portion having: a lower first member, a lower second member, a lower arm, a lower first protrusion, and a lower second protrusion. The first member being defined by the upper first member and the lower first member. The second member being defined by the upper second member and the lower second member. The arm being defined by the upper arm and the lower arm. The first protrusion being defined by the upper first protrusion and lower first protrusion. The second protrusion being defined by the upper second protrusion and the lower second protrusion. The upper portion and the lower portion being connected to each other for sandwiching the U-shaped tow eye.

In some embodiments, the arm is a first arm, the upper arm is an upper first arm, and the lower arm is a lower first arm. The adapter body further includes a second arm spaced apart from the first arm and extending between the first member and the second member. The upper portion further includes an upper second arm and the lower portion further includes a lower second arm. The second arm being defined by the upper second arm and the lower second arm. The space is further defined by the second arm.

In some embodiments, the upper second arm has a projection defining a notch. The lower second arm has an extension. The notch receives the extension.

In some embodiments, the projection is a first projection, the notch is a first notch, and the extension is a first extension. The upper second arm further includes a second projection defining a second notch and the lower second arm further includes a second extension. The first projection is disposed at a first end of the upper second arm and the second projection is disposed at a second end of the upper second arm. The first extension is disposed at a first end of the lower second arm and the second extension is disposed at a second end of the lower second arm. The first notch receives the first extension, and the second notch receives the second extension.

In some embodiments, the upper first member includes an inner first member surface and a first inner projection extending from the inner first member surface. The first inner projection defines a first channel. The lower first member defines a first opening aligned with the first channel. The cleat adapter further includes a first connector received in the first opening and the first channel for connecting the first portion to the second portion.

In some embodiments, the upper second member includes an inner second member surface and a second inner projection extending from the inner second member surface. The second inner projection defines a second channel. The lower second member defines a second opening aligned with the second channel. The cleat adapter further includes a second connector received in the second opening and the second channel for connecting the first portion to the second portion.

In some embodiments, the lower first member includes a first recessed portion. The first opening is defined by the first recessed portion. The lower second member comprises a second recessed portion. The second opening is defined by the second recessed portion.

In some embodiments, the arm is a first arm. The adapter body further comprises a second arm spaced apart from the first arm and extending between the first member and the second member. The space is further defined by the second arm.

In some embodiments, the first protrusion is disposed at an end portion of the first member. The first protrusion has a first outer face flush with an outer side of the arm. The second protrusion is disposed at an end portion of the second member. The second protrusion has a second outer face flush with the outer side of the arm.

In some embodiments, the first portion is formed as a first unitary piece and the second portion is formed as a second unitary piece.

According to another aspect of the present technology, a watercraft is provided. The watercraft includes a watercraft body, a U-shaped tow eye connected to and extending rearward from a surface of the watercraft body, and a cleat adapter connected to the U-shaped tow eye. The cleat adapter has a first portion and a second portion connected to the first portion. The first portion and the second portion together defining an adapter body. The adapter body defines a passage receiving a portion of the U-shaped tow eye and capturing the portion of the U-shaped tow eye in the adapter body. The adapter body includes: a first member, a second member, and an arm extending between the first member and the second member. The first member, the second member, and the arm together defining a generally U shape. The first member, the second member, and the arm together defining a space for receiving a tow cord. The adapter body further includes a first protrusion for retaining a first portion of the tow cord, the first protrusion extending laterally outward from the first member, and a second protrusion for retaining a second portion of the tow cord, the second protrusion extending laterally outward from the second member.

In some embodiments, the first portion is an upper portion having: an upper first member, an upper second member, an upper arm, an upper first protrusion, and an upper second protrusion. The second portion is a lower portion having: a lower first member, a lower second member, a lower arm, a lower first protrusion, and a lower second protrusion. The first member being defined by the upper first member and the lower first member. The second member being defined by the upper second member and the lower second member. The arm being defined by the upper arm and the lower arm. The first protrusion being defined by the upper first protrusion and lower first protrusion. The second protrusion being defined by the upper second protrusion and the lower second protrusion. The U-shaped tow eye is disposed between the upper portion and the lower portion.

In some embodiments, the U-shaped tow eye includes a first straight portion having a first stopper and a second straight portion having a second stopper. The adapter body further includes a second arm abutting the surface of the watercraft body and extending between the first member and the second member, the second arm being disposed forward of the first arm. The upper portion further includes an upper second arm defining a first upper semi-circular notch and a second upper semi-circular notch. The lower portion further includes a lower second arm defining a first lower semi-circular notch and a second lower semi-circular notch. The first upper semi-circular notch and the first lower semi-circular notch receives the first stopper. The second upper semi-circular notch and the second lower semi-circular notch receives the second stopper. The second arm being defined by the upper second arm and the lower second arm. The space is further defined by the second arm.

According to another aspect of the present technology, a method for attaching a cleat adapter to a U-shaped tow eye is provided. The method includes: positioning a first portion of the cleat adapter onto the U-shaped tow eye, positioning a second portion of the cleat adapter onto the U-shaped tow eye, and connecting the first portion to the second portion to capture the U-shaped to eye between the first portion and the second portion.

In some embodiments, the first portion is an upper portion, and the second portion is a lower portion. Thus, positioning the first portion of the cleat adapter involves positioning the upper portion on top of the U-shaped tow eye, positioning the second portion of the cleat adapter comprises positioning the lower portion below the U-shaped tow eye, and connecting the upper portion to the lower portion sandwiches the U-shaped tow eye between the upper portion and the lower portion.

In some embodiments, connecting the upper portion to the lower portion includes inserting a connector into an opening of one of the upper portion and the lower portion, and receiving a portion of the connector into a channel of another one of the upper portion and the lower portion.

In some embodiments, connecting the upper portion to the lower portion includes inserting a first semi-circular protrusion of the lower portion in a first semi-circular notch of the upper portion, inserting a second semi-circular protrusion of the lower portion in a second semi-circular notch of the upper portion, inserting a first connecting into an opening of the first semi-circular protrusion, and inserting a second connector into an opening of the second semi-circular protrusion.

In some embodiments, connecting the upper portion to the lower portion comprises receiving an extension of one of the upper portion and the lower portion in a notch defined bye another one of the upper portion and the lower portion In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

It must be noted that, as used in this specification and the appended claims, the singular form "a", "an" and "the" include plural referents unless the context clearly dictates otherwise.

As used herein, the term "and/or" is to be taken as specific disclosure of each of the two specified features or components with or without the other. For example, "A and/or B" is to be taken as specific disclosure of each of (i) A, (ii) B and (iii) A and B, just as if each is set out individually herein.

For purposes of this application, terms related to spatial orientation such as forward, rearward, upward, downward, left, and right, should be understood by a driver of a watercraft in which the watercraft is in a neutral trim position with the driver in a driving position.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
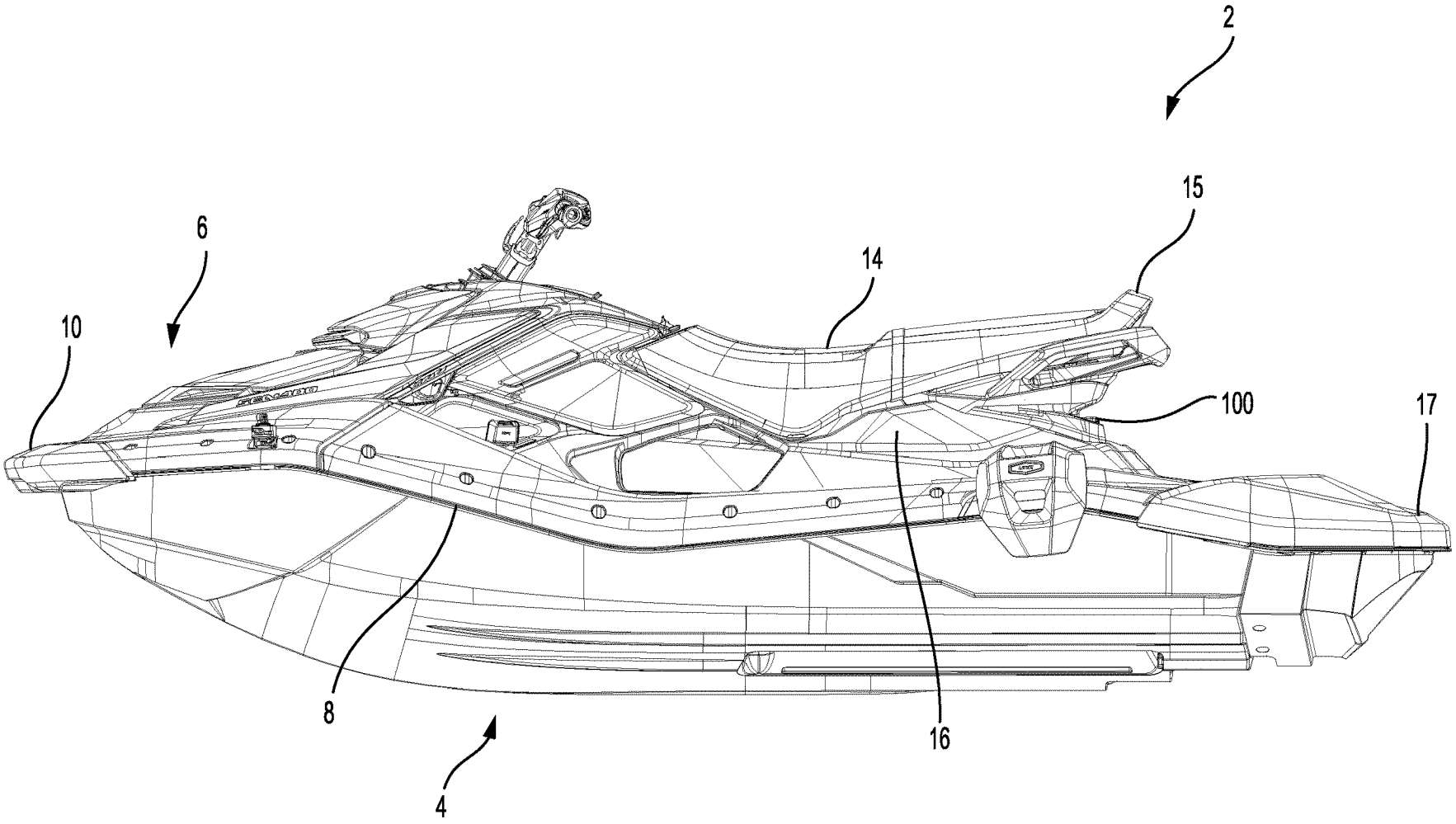
FIG. 1 is a left side elevation view of a personal watercraft with a cleat adapter, in accordance with the present technology.
Figure 2:
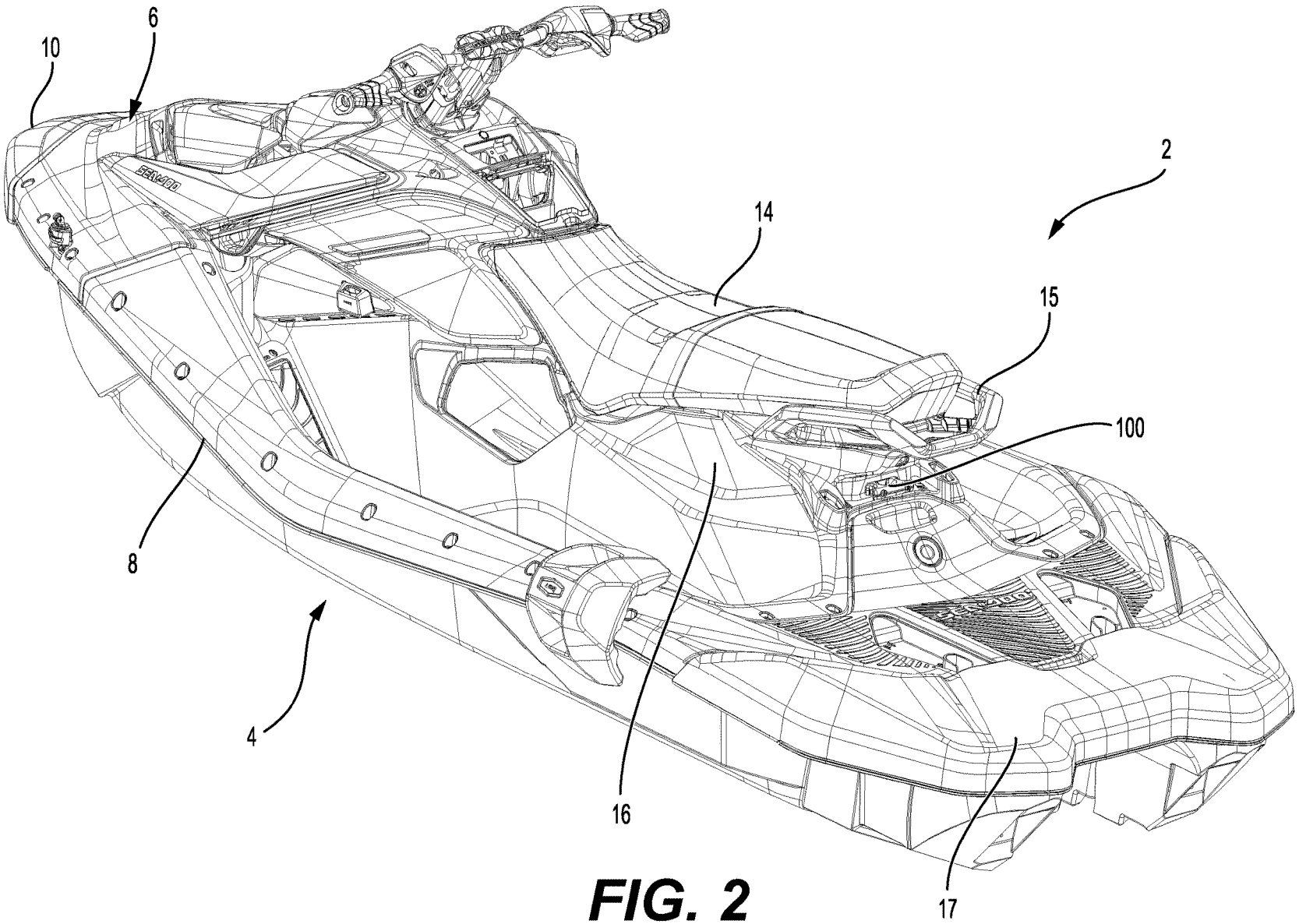
FIG. 2 is a perspective view, taken from a rear, left side of the personal watercraft of FIG. 1 with the cleat adapter.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

FIGS. 1 to 4 illustrate a personal watercraft 2 in accordance with the present invention. The personal watercraft 2 is made of two main parts. These parts are the hull 4 and the deck 6, which is disposed on the hull 4. The hull 4 buoyantly supports the watercraft 2 in the water. The deck 6 is designed to accommodate a rider and, in some watercraft, one or more passengers. The hull 4 and deck 6 are joined together at the bond line 8 by fasteners, more particularly screws. Adhesive and other types of fasteners, such as bolts or rivets may also be used to join the hull 4 to the deck 6. A bumper 10 generally covers the bond line 8, which helps to prevent damage to the outer surface of the watercraft 2 when the watercraft 2 is docked. The volume created between the hull 4 and the deck 6 is known as the engine compartment. The engine compartment accommodates the engine (not shown) as well as the muffler, exhaust pipe, gas tank, electrical system (battery, electronic control unit, etc.), air box, storage bins and other elements required by or desired for the watercraft 2. In an alternative embodiment, the engine compartment may accommodate an electric motor, batteries, and associated components.

The deck 6 has a centrally positioned straddle-type seat 14 placed on top of a pedestal 16 to accommodate a rider in a straddling position. A grab handle 15 is provided between the pedestal 16 and the straddle-type seat 14 at the rear of the straddle-type seat 14 to provide a handle onto which a passenger may hold on. The seat 14 is removably attached to the pedestal 16 by a hook and tongue assembly (not shown) at the front of the seat 14 and by a latch assembly (not shown) at the rear of the seat 14, or by any other known attachment mechanism. The seat 14 covers an engine access opening (not shown), defined by a top portion of the pedestal 16, which provides access to the engine (not shown).

Figure 3:
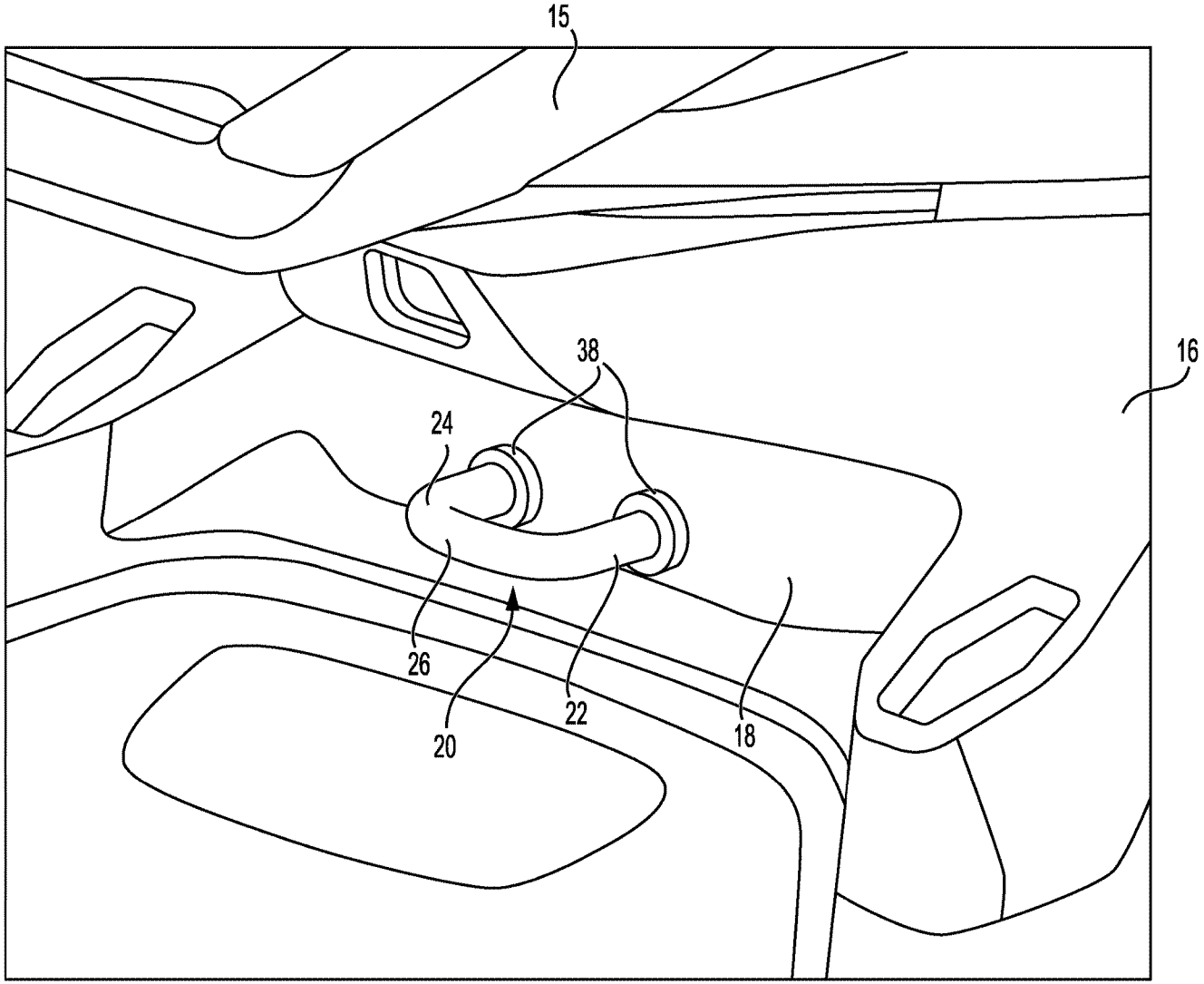
FIG. 3 is a close-up perspective view, taken from a rear, right side of a rear portion of a pedestal of the personal watercraft of FIG. 1 with the cleat adapter removed.

As shown in FIG. 3, a U-shaped tow eye 20 is positioned on a rear surface 18 of the pedestal 16 and extends rearward from the surface 18. The U-shaped tow eye 20 is mounted to the pedestal 16, below the seat 14. In an alternative embodiment, the U-shaped tow eye 20 may be mounted at the rear of the reboarding platform 17. It is contemplated that that U-shaped tow eye 20 may be mounted to another suitable location on the watercraft 2.

With reference to FIGS. 3, and 5 to 10, the U-shaped tow eye 20 will now be described in further detail. The U-shaped tow eye 20 includes two straight portions 22, 24 (a right straight portion 22 and a left straight portion 24) connected by a curved portion 26 that extends between the two straight portions 22, 24. A threaded portion 28 is disposed at each front end section 30, 32 of the two straight portions 22, 24 such that the U-shaped tow eye 20 may be secured to the watercraft 20 via fasteners, such as nuts 34, and washers 36. The U-shaped tow eye 20 includes two shoulders 39. One of the two shoulders 39 being defined by the right straight portion 22 and the other one of the two shoulders 39 being defined by the left straight portion 24. The U-shaped tow eye 20 further includes two stoppers 38. In the present embodiment, the stoppers 38 are washers 38 that abut the shoulders 39. It is contemplated that, in an alternative embodiment, the stoppers 38 may be flanges.

Figure 5:
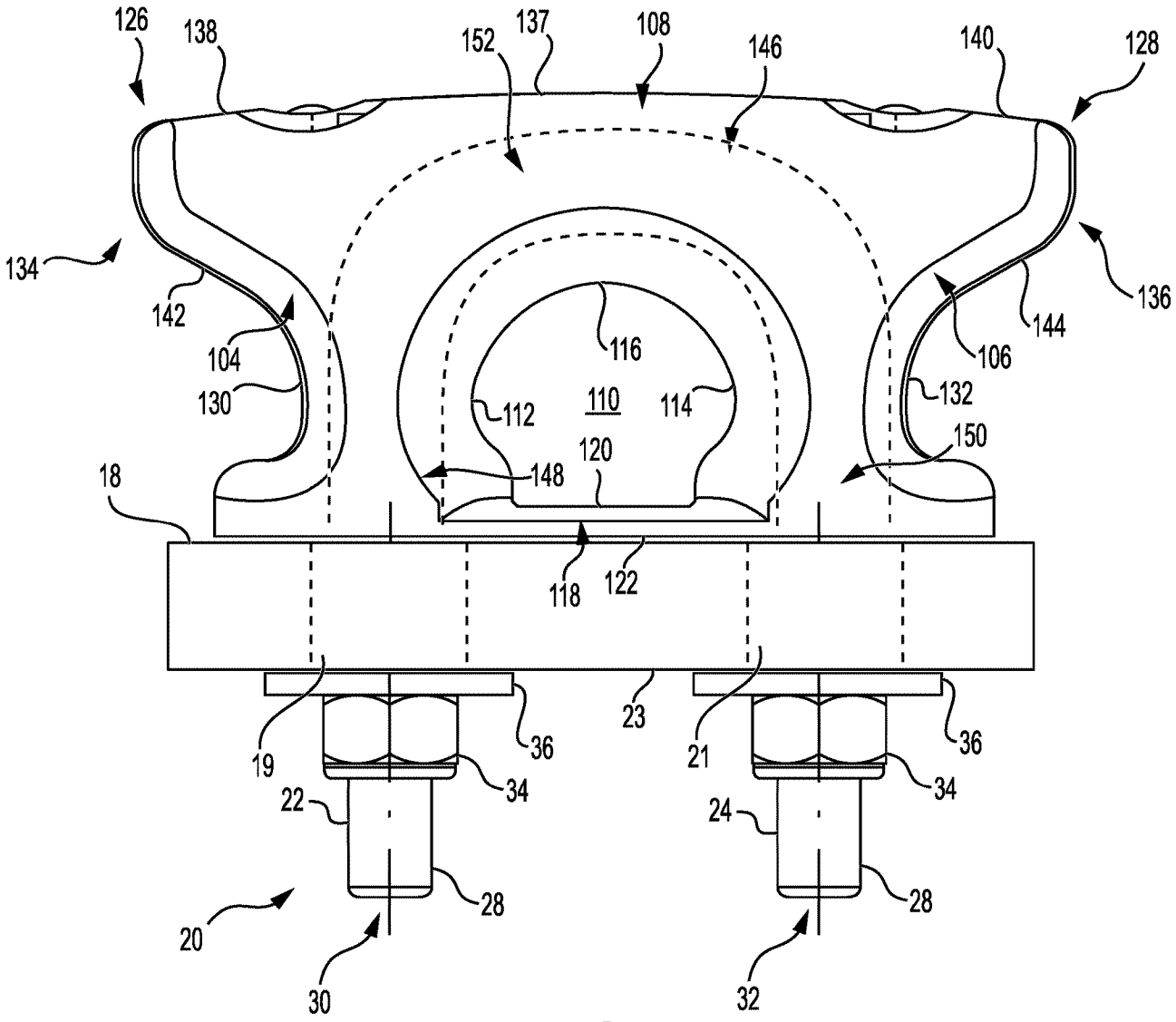
FIG. 5 is a top view of the cleat adapter of FIG. 1 mounted on a U-shaped tow eye.

The surface 18 on which the U-shaped tow eye 20 is mounted includes a right opening 19 and a left opening 21 (as depicted in FIG. 5) that receive a respective end section 30, 32 of the straight portions 22, 24. The end section 30 of the right straight portion 22 is inserted into the right opening 19 and the end section 32 of the left straight portion 24 is inserted into the left opening 21. Each end section 30, 32 extends forwards from the inner surface 23 of the pedestal 16. A nut 34 and a washer 36 is disposed on each end section 30, 32, fastening the U-shaped tow eye 20 to the watercraft 2. Once fastened, the washers 36 abut the inner surface 23 and the washers 38 abuts the surface 18. It is contemplated that other fastening systems may be used to fasten the U-shaped tow eye 20 to the watercraft 2. In an alternative embodiment, the washers 38 may be omitted.

The watercraft 2 includes a cleat adapter 100 connected to the U-shaped tow eye 20 to receive and retain a tow cord 40. The cleat adapter 100 makes it simpler to attach the tow cord 40 to the watercraft 2 than the U-shaped tow eye 20. With reference to FIGS. 4 to 11, the cleat adapter 100 includes an adapter body 102 having a right member 104, a left member 106, and a rear arm 108 extending between the left member 104 and the right member 106. The adapter body 102 defines a generally U shape. The adapter body 102 further includes a front arm 118 that is spaced apart from the rear arm 108 and extends between the right member 104 and the left member 106. The front arm 118 is panel-like and has an outer side 122 abutting the surface 18. It is contemplated that, an alternative embodiment, the front arm 118 may be omitted.

The right member 104, the left member 106, the rear arm 108, and the front arm 118 define a space 110 for receiving the tow cord 40. As depicted in FIG. 5, when viewed from above, the space 110 is generally circular. That is, an inner sidewall 112 of the right member 104, an inner sidewall 114 of the left member 104, an inner side of the rear arm 108 curve inward, and an inner side 120 of the panel-like portion of the front arm 118 defines the generally circular space 110.

With further reference to FIG. 5, the adapter body 102 further includes a right protrusion 126 and a left protrusion 128. Each protrusion 126, 128 extends laterally outward for retaining the tow cord 40. The right protrusion 126 extends from an outer sidewall 130 of the right member 104. The left protrusion 128 extends from an outer sidewall 132 of the left member 106. The right and the left protrusions 126, 128 extend continuously from the respective sidewalls 130, 132. That is, the right protrusion 126 includes a sloped section 142 which angles towards and connects to the outwardly curved outer sidewall 130 of the right member 104. Similarly, the left protrusion 128 includes a sloped section 144 which angles towards and connects to the outwardly curved outer sidewall 132 of the left member 106. The right protrusion 126 is disposed at an end portion 134 of the right member 104 and the left protrusion 128 is disposed at an end portion 136 of the left member 106. The protrusions 126, 128 do not extend past an outer side 137 of the rear arm 108. In other words, an outer face 138 of the right protrusion 126 is flush with the outer side 137 of the rear arm 108. Similarly, an outer face 140 of the left protrusion 128 is flush with the outer side of the rear arm 108.

Figure 11:
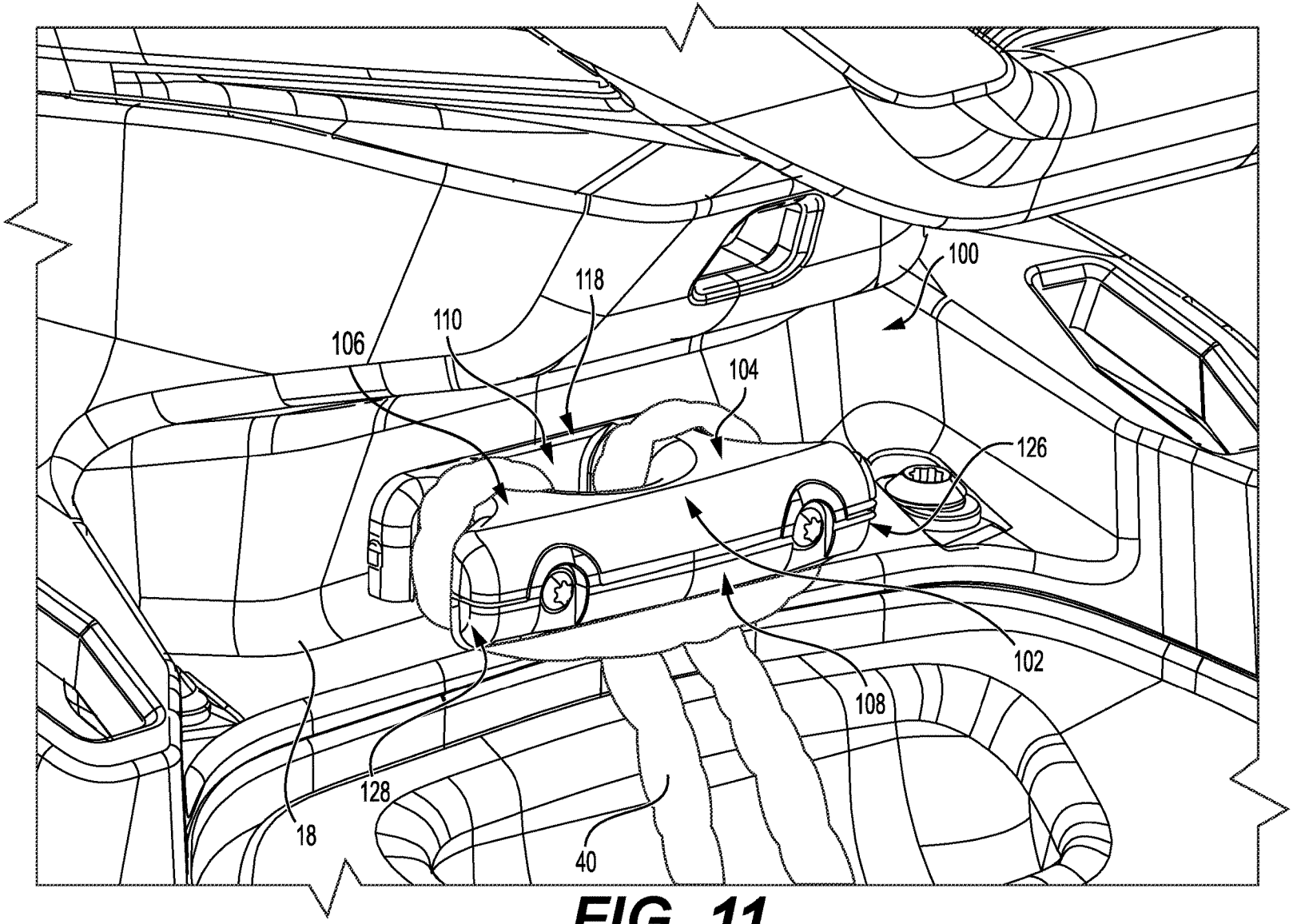
FIG. 11 is a perspective view taken from a rear, left side of the personal watercraft of FIG. 1 with a tow rope attached to the cleat adapter.

With reference to FIG. 11, to attach the tow cord 40 to the cleat adapter 100, a looped end of the tow cord 40 is inserted through the space 110 and looped around the adapter body 102 as shown, such that each of the protrusions 126, 128 retains a portion of the looped tow cord 40. Specifically, a right portion of the tow cord 40 is positioned within the curved outer sidewall 130 of the right member 104 and a left portion of the tow cord 40 is positioned within the curved outer sidewall 132 of the left member 106. The tow cord 40 is then pulled tight. The protrusions 126, 128 retain the tow cord 40, preventing the portion of the looped tow cord 40 from sliding rearwardly off the cleat adapter 100.

It is contemplated that, in an alternative embodiment, the two protrusions 126, 128 may be disposed anywhere along the outer sidewalls 130, 132 of the right and the left members 104, 106 so long as there is a gap between the two protrusions 126, 128 and the surface 18 of the watercraft 2 for the tow cord 40 to be positioned. In another alternative embodiment, the protrusions 126, 128 may be disposed on a top surface or a bottom surface of the right and the left members 104, 106. It a further alternative embodiment, the protrusions 126, 128 may be positioned in any combination of the positions described.

Figure 6:
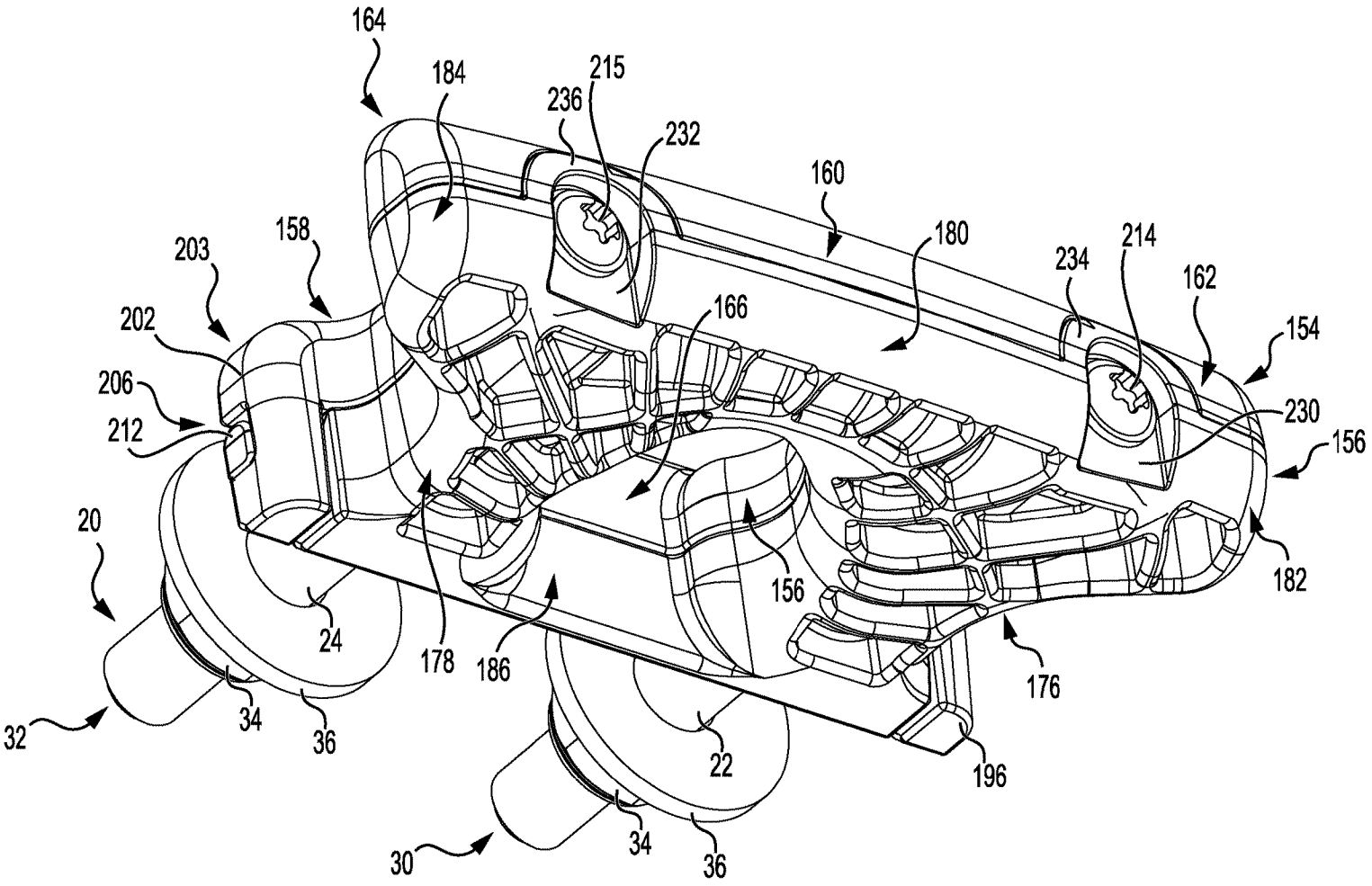
FIG. 6 is a perspective view taken from a bottom, rear, left side of the cleat adapter and U-shaped tow eye of FIG. 5.

As depicted in FIG. 6, the adapter body 102 defines a passage 146 that receives and captures a portion of the U-shaped tow eye 20. The passage 146 is generally U-shaped to receive portions of the U-shaped tow eye 20. The right member 104 defines a right passage portion 148 which receives the right straight portion 22 of the U-shaped tow eye 20. The right passage portion 148 spans nearly the entire length of the right member 104. The left member 106 defines a left passage portion 150 which receives the left straight portion 24 of the U-shaped tow eye 20. The left passage portion 150 spans nearly the entire length of the left member 106. The rear arm 108 defines a curved passage portion 152 which receives the curved portion 26 of the U-shaped tow eye 20. The curved passage portion 152 spans the entire width of the rear arm 108. The front arm 118 defines circular openings for receiving the washers 38 of the U-shaped tow eye 20. It is contemplated that, in an alternative embodiment, the adapter body 102 may include retaining clips for receiving and capturing portions of the U-shaped tow eye 20.

Figure 4:
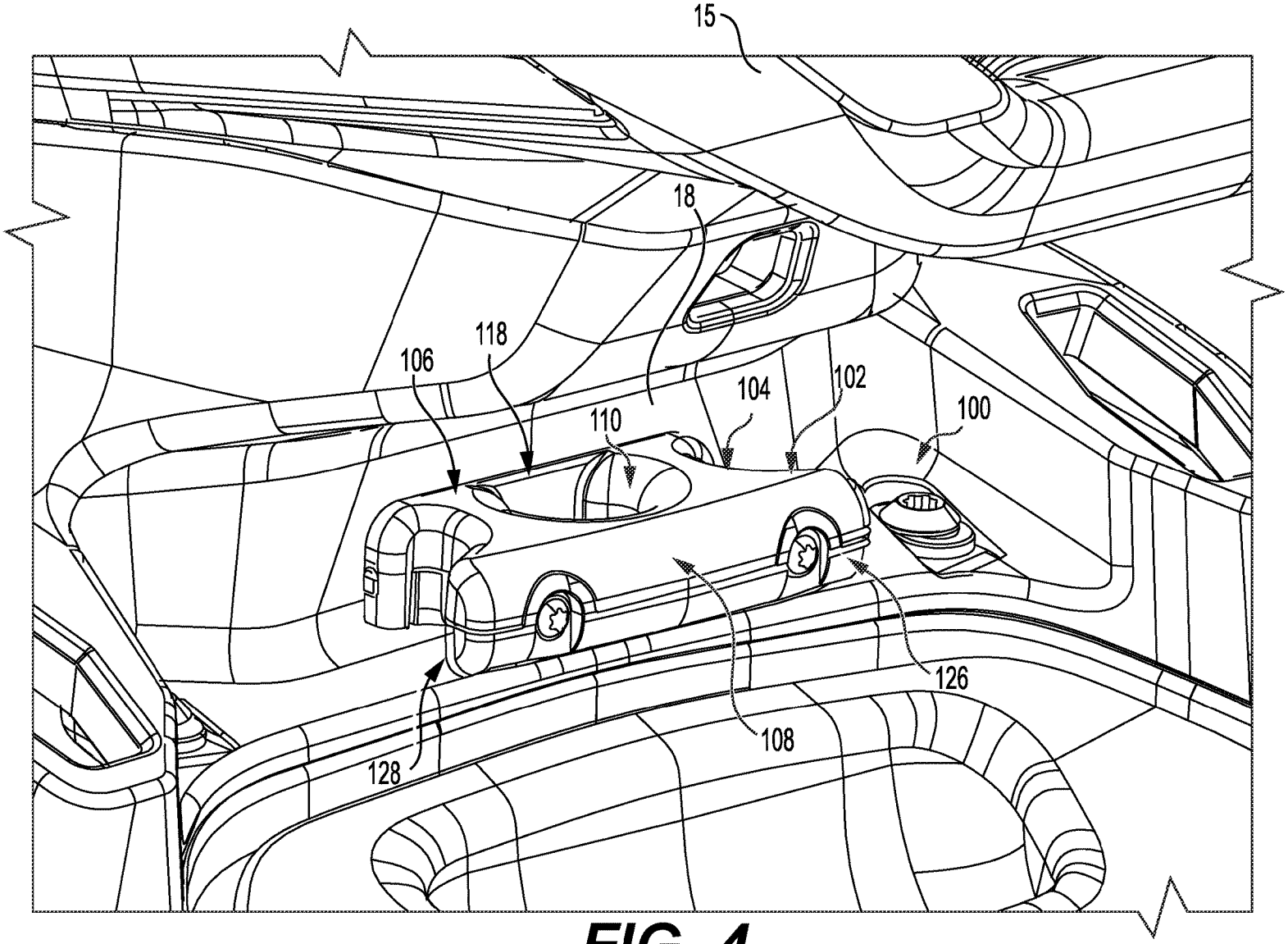
FIG. 4 is a perspective view, taken from a rear, left side, of the rear portion of the pedestal of the personal watercraft of FIG. 1.

As depicted in FIGS. 4 and 5, when the cleat adapter 100 is connected to the U-shaped tow eye 20, the adapter body 102 encloses the entire portion of the U-shaped tow eye 20 that extends rearward from the surface 18 of the watercraft 2. It is contemplated that, in an alternative embodiment, the adapter body 102 may be sized such that it covers only a portion of the U-shaped tow eye 20 that extends from the surface 18.

With reference to FIGS. 6 to 10, the cleat adapter 100 includes an upper portion 154 and a lower portion 156 which connect together to define the adapter body 102. The upper portion 154 and the lower portion 156 sandwich the U-shaped tow eye 20. The upper portion 154 and lower portion 156 are connected via connectors and interlocking features which will be described in further detail below.

It is contemplated that the adapter body 102 may be defined by lateral components which connect in a side-to-side configuration (for example, a left portion and a right portion). It is further contemplated that the adapter body 102 may be defined by any number of portions that connect with one another to receive and capture the U-shaped tow eye 20.

Figure 7:
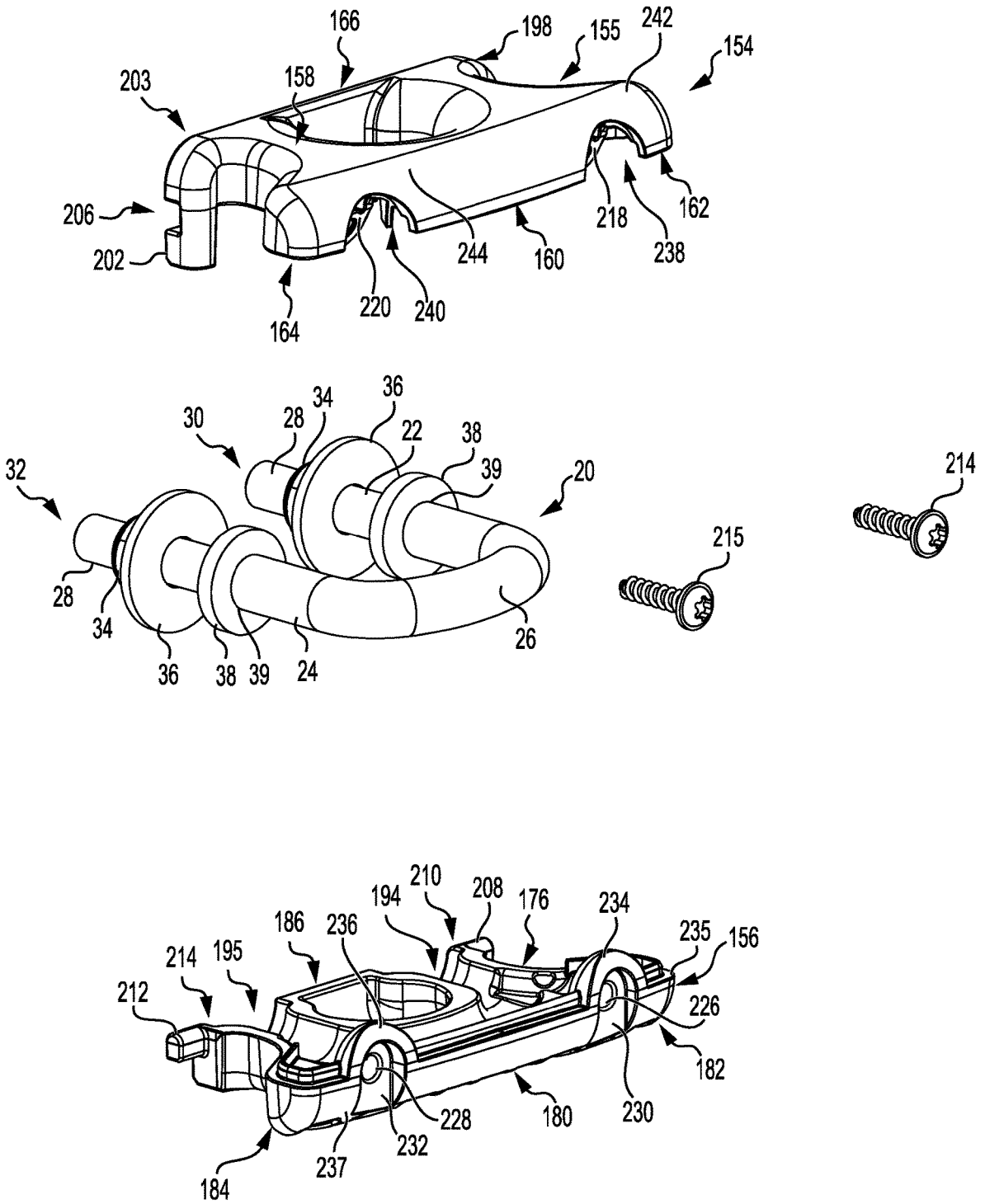
FIG. 7 is an exploded perspective view taken from a rear, left side of the cleat adapter and U-shaped tow eye of FIG. 5.
Figure 8:
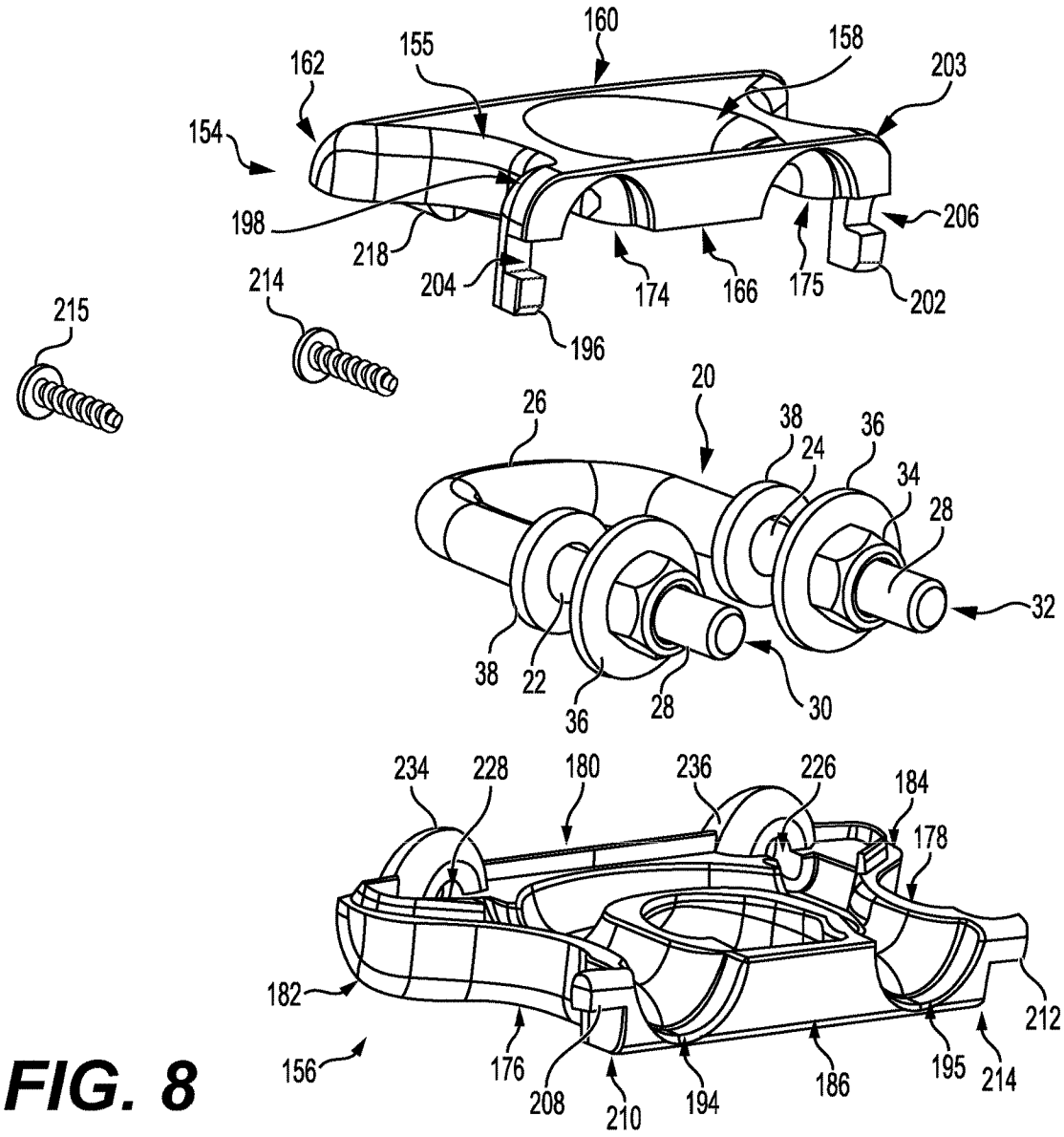
FIG. 8 is an exploded perspective view taken from a front, right side of the cleat adapter and U-shaped tow eye of FIG. 5.
Figure 9:
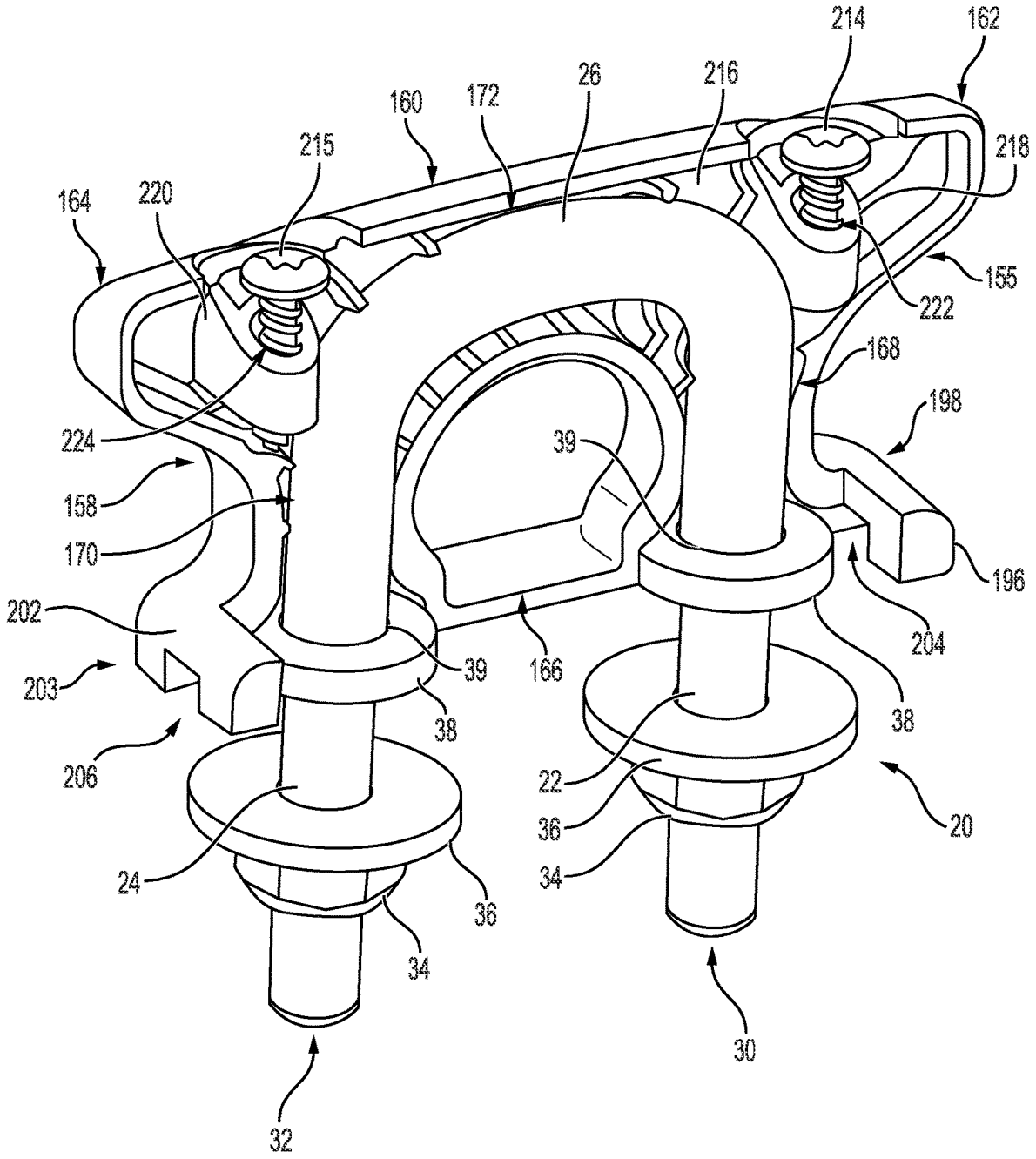
FIG. 9 is a perspective view taken from a bottom, rear, left side of the cleat adapter and U-shaped tow eye of FIG. 5 with a lower portion of the cleat adapter being removed.

With reference to FIGS. 7 to 9, the upper portion 154 defines an upper half of the adapter body 102. As such, the upper portion 154 includes an upper right member 155, an upper left member 158, an upper rear arm 160, an upper right protrusion 162, an upper left protrusion 164, and an upper front arm 166.

As depicted in FIG. 9, the upper portion 154 defines an upper section of the passage 146 to receive a top half of the U-shaped tow eye 20. That is, an upper section of the right passage portion 168 is defined by the upper right member 155, an upper section of the left passage portion 170 is defined by the upper left member 158, an upper section of the curved passage portion 172 is defined by the upper rear arm 160, and two upper semi-circular notches 174, 175 are defined by the upper front arm 166 (FIG. 8).

Figure 10:
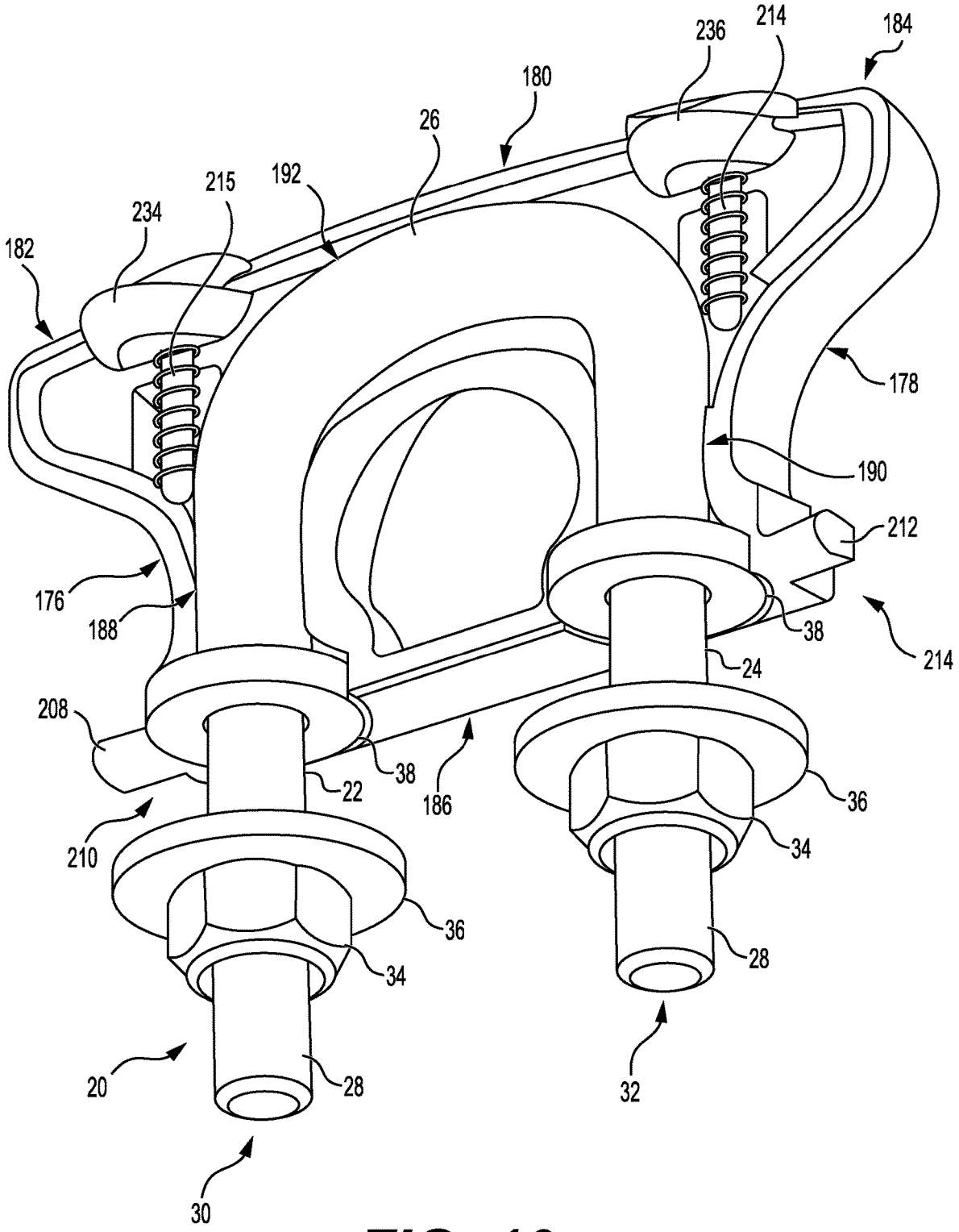
FIG. 10 is a perspective view taken from a top, front, left side of the cleat adapter and U-shaped tow eye of FIG. 5, with an upper portion of the cleat adapter being removed.

With reference to FIGS. 7, 8 and 10, the lower portion 156 defines a lower half of the adapter body 102. As such, the lower portion 156 includes a lower right member 176, a lower left member 178, a lower rear arm 180, a lower right protrusion 182, a lower left protrusion 184, and a lower front arm 186.

As depicted in FIG. 10, the lower portion 156 defines a lower section of the passage 146 to receive a lower half of the U-shaped tow eye. That is, a lower section of the right passage portion 188 is defined by the lower right member 176, a lower section of the left passage portion 190 is defined by the lower left member 178, a lower section of the curved passage portion 192 is defined by the lower rear arm 180, and two lower semi-circular notches 194, 195 are defined by the lower front arm 186.

As previously described, the upper portion 154 and the lower portion 156 connect together to form the adapter body 102. Thus, the right member 104 is defined by the upper right member 155 and the lower right member 176. The left member 106 is defined by the upper left member 158 and the lower left member 178. The rear arm 108 is defined by the upper rear arm 160 and the lower rear arm 180. The front arm 118 is defined by the upper front arm 166 and the lower front arm 186.

Figure 12:
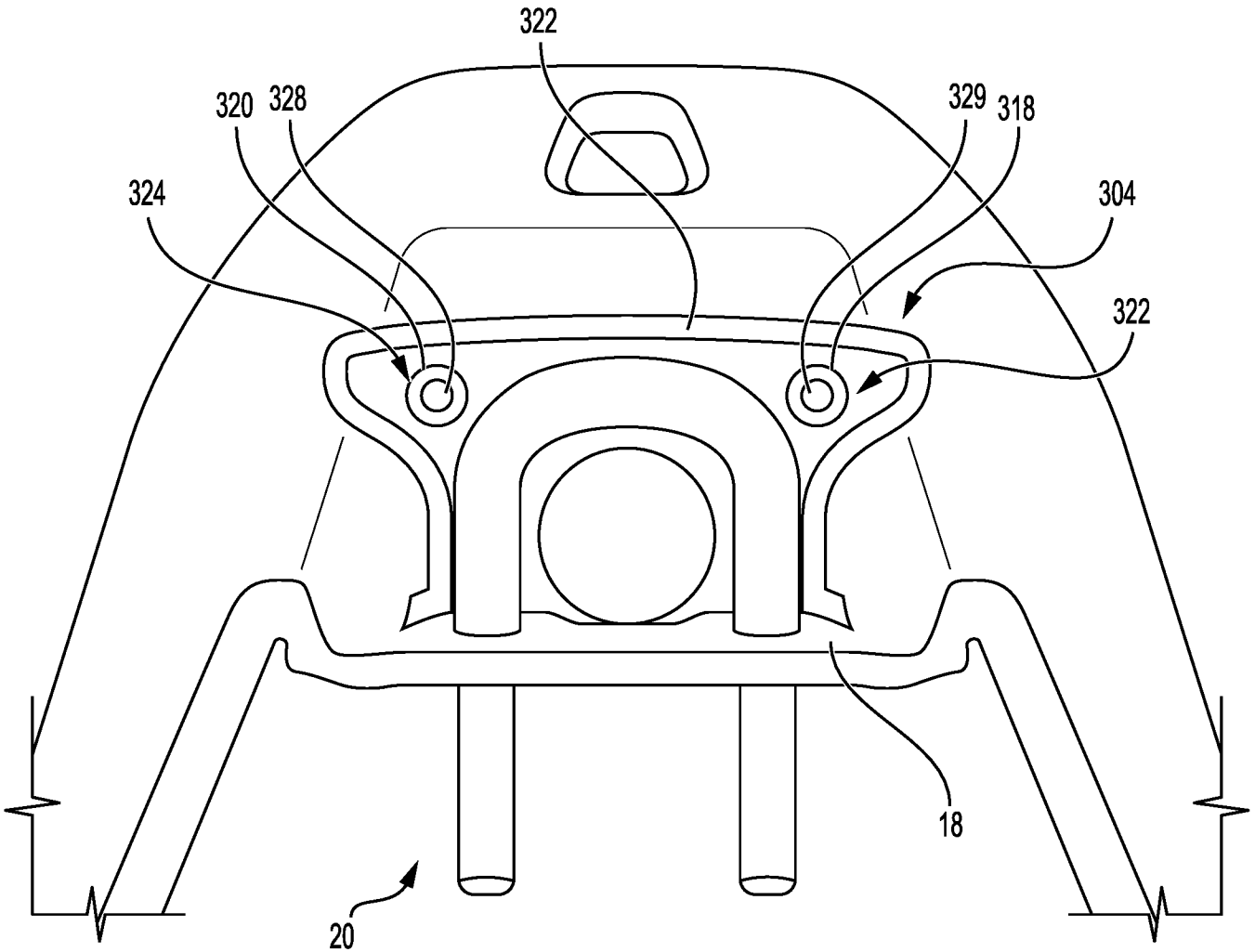
FIG. 12 is a bottom view of an alternative embodiment of a cleat adapter, shown on a U-shaped tow eye connected to a portion of a watercraft, with a lower portion of the cleat adapter being removed.
Figure 13:
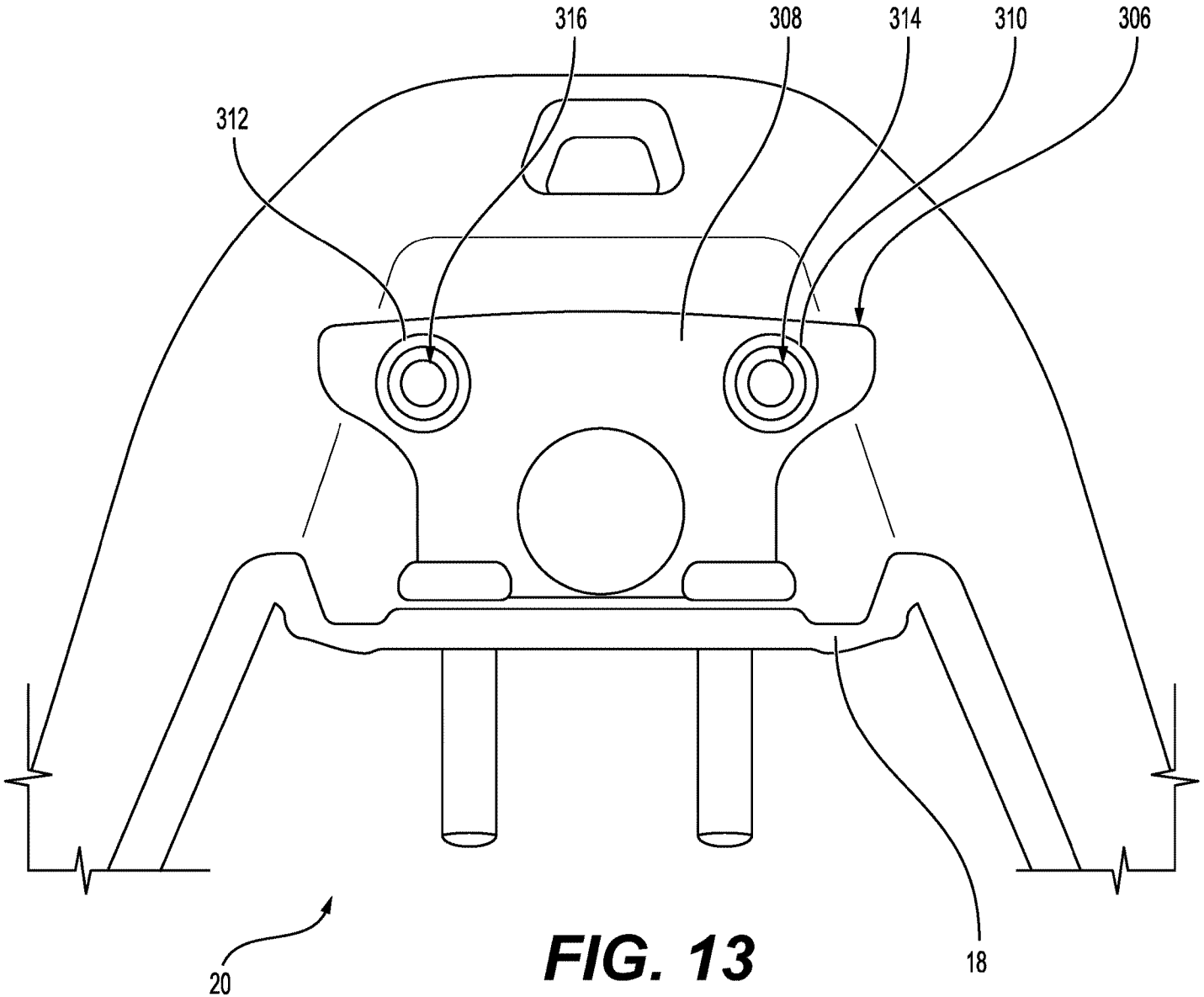
FIG. 13 is a bottom view of the cleat adapter and other components of FIG. 12, with an upper portion and fasteners of the cleat adapter being removed.
Figure 14:
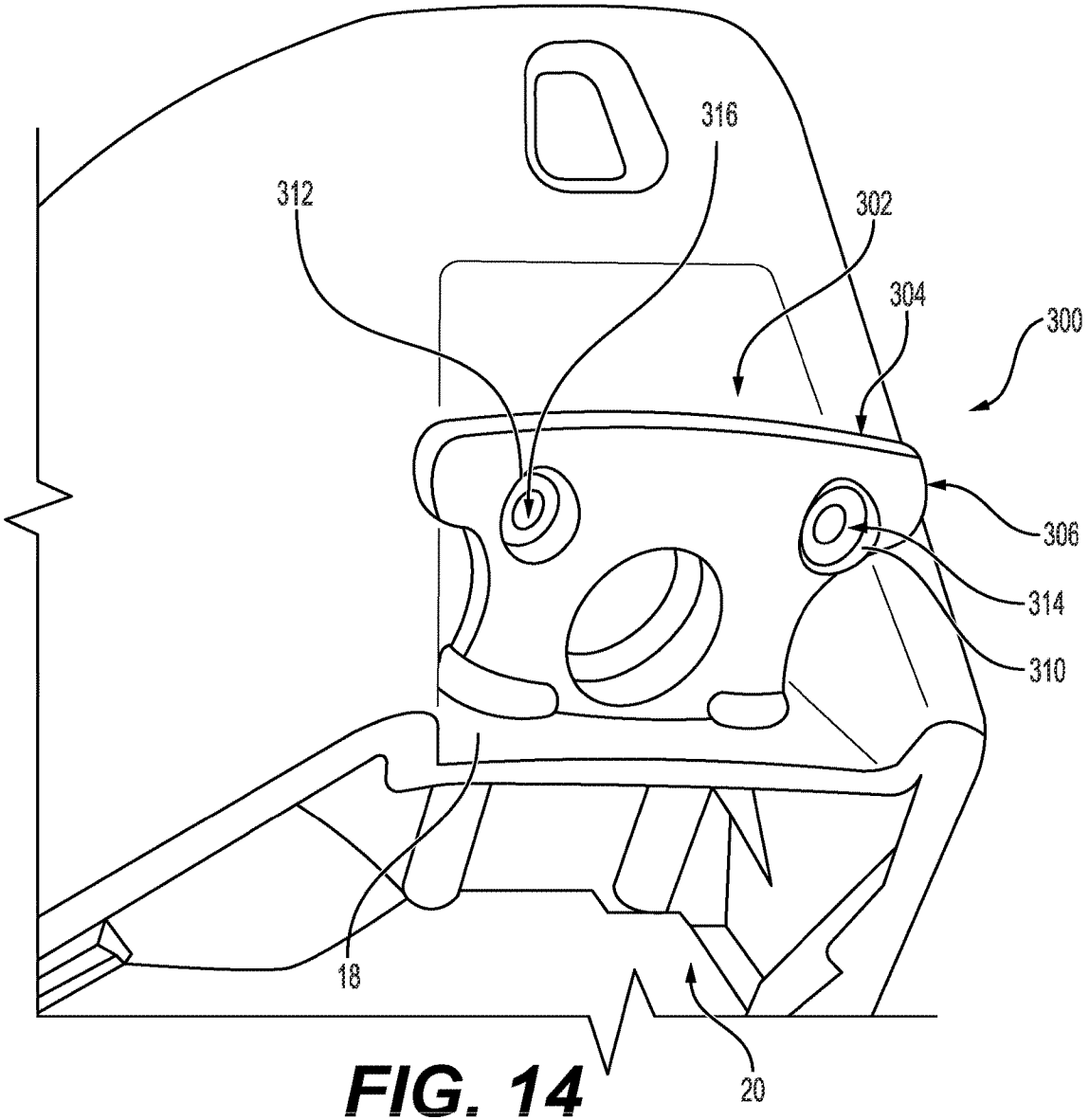
FIG. 14 is a perspective view taken from a bottom, rear, left side of the cleat adapter and components of FIGS. 12 and 13.

The upper portion 154 and the lower portion 156 include interlocking components for connecting the upper and the lower portions 154, 156 together. The interlocking components include projections 196, 202 having notches 204, 206 that receive extensions 208, 212. Specifically, the upper second arm 166 includes a right projection 196 disposed at a right end portion 198 and a left projection 202 disposed at a left end portion 203. The right projection 196 extends downward from a right end of the upper front arm 166 and defines a notch 204. The left projection 202 extends downward from a left end of the upper front arm 166 and defines a notch 206. The lower front arm 186 includes a right extension 208 disposed at the right end 210 and a left extension 212 disposed at the left end 211. Each of the extensions 208, 212 extends laterally outward from its respective end 210, 211. The notches 204, 206 are sized to receive the extensions 208, 212. The notch 204 on the right projection 196 receives the right extension 208 and the notch 206 on the left projection 202 receives the left extension 212, connecting the upper portion 154 and the lower portion 156 together. In an alternative embodiment, the extensions 208, 212 may be disposed on the upper portion 154 and the projections 196, 202 defining the notches 204, 206 may be disposed on the lower portion 156. It is contemplated that any number of projections 196, 202 and extensions 208, 212 may be used for connecting the upper portion 154 and the lower portion 156 together. It is further contemplated that the projections 196, 202 and the extensions 208, 212 may be disposed at any location on the upper portion 154 and the lower portion 156. In an alternative embodiment, the projections 196, 202 and the extensions 208, 212 may be omitted (for example, as depicted in FIGS. 12 to 14).

With reference to FIGS. 7 to 10, the upper portion 154 and the lower portion 156 receive two connectors, such as screws 214, 215. As depicted in FIG. 9, the upper portion 154 defines an inner surface 216 on which a right inner projection 218 and a left inner projection 220 extend. The right projection 218 extends from the inner surface 216 of the upper right member 155 and the left inner projection 220 extends from the inner surface 216 of the upper left member 158. The right inner projection 218 defines a first threaded aperture 222. The left inner projection 220 defines a second threaded aperture 224.

With reference to FIG. 7, the upper portion 154 defines two semi-circular notches 238, 240. A right semi-circular notch 238 is defined by an outer face 242 of the upper right member 155 and a left semi-circular notch 240 is defined by an outer face 244 of the upper left member 158. The semi-circular notches 238, 240 being positioned forwardly of and in alignment with the inner projections 218, 220.

With continued reference to FIG. 7, the lower portion 156 defines a right semi-circular protrusion 234 and a left semi-circular protrusion 236. The right semi-circular protrusion 234 is received in the right semi-circular notch 238 of the upper portion 154 and the left semi-circular protrusion 236 is received in the left semi-circular notch 240 of the upper portion 154. The right semi-circular protrusion 234 extends upward from the lower right member 176 and defines a portion of an outer face 235 of the lower right member 176. The left semi-circular protrusion 236 extending upward from the lower left member 178 and defines a portion of an outer face 237 of the lower left member 178. The right semi-circular protrusion 234 includes a recessed portion 230 defining an opening 226. The recessed portion 230 extends inwardly from the outer face 234. The left semi-circular protrusion 236 includes a recessed portion 232 defining an opening 228. The recessed portion 232 extends inwardly from the outer face 236. The opening 226 aligns with the threaded aperture 222 of the right inner projection 218. A screw 214 is inserted into the opening 226 and the threaded aperture 222. The opening 228 aligns with the threaded aperture 224 of the left inner projection 220. A screw 215 is inserted into the opening 228 and the threaded aperture 224. The recessed portions 230, 232 act as a shoulder for each of the screws 214, 215.

As depicted in FIGS. 4 to 11, the upper portion 154 is formed as a first unitary piece and the lower portion 156 is formed as a second unitary piece. It is contemplated that the upper portion 154 may be formed of multiple pieces which are configured to be assembled. Similarly, it is contemplated that the lower portion 156 may be formed of multiple pieces which are configured to be assembled.

Figure 15:
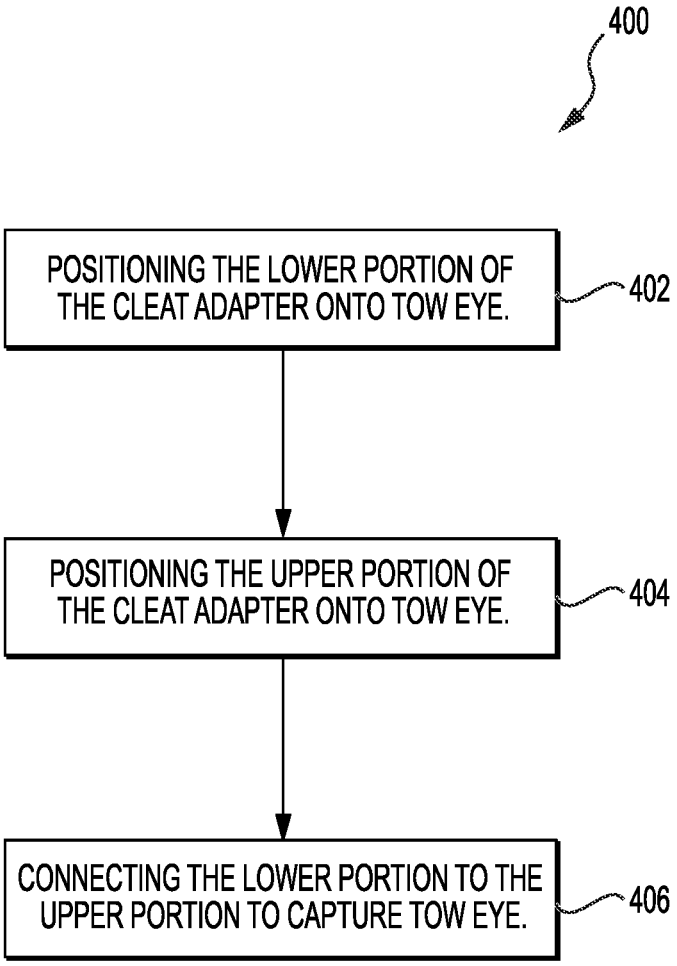
FIG. 15 is a flow chart illustrating a method of attaching a cleat adapter to a watercraft.

With reference to FIG. 15, a method 400 of attaching the cleat adapter 100 to the U-shaped tow eye 20 will be described.

The method 400 begins at step 402 with the positioning of the lower portion 156 of the cleat adapter 100 onto the U-shaped tow eye 20, such that the U-shaped tow eye 20 is received in the lower section of the passage 146.

The method 400 continues with step 404 with the positioning of the upper portion 154 of the cleat adapter 100 onto the U-shaped tow eye 20, such that the U-shaped tow eye 20 is received in the upper section of the passage 146. The right extension 210 is received in the notch 204 of the right projection 196 and the left extension 212 is received in the notch 206 of the left projection 202, interlocking the upper portion 154 and the lower portion 156. The right semi-circular protrusion 234 is received in the right semi-circular notch 238, aligning the opening 226 with the threaded aperture 222 of the right inner projection 218. The left semi-circular protrusion 236 is received in the left semi-circular notch 240, aligning the opening 228 with the threaded aperture 224 of the left inner projection 220.

Finally, the method 400 includes step 406 with the connecting of the lower portion 156 with the upper portion 154 to capture the U-shaped tow eye 20. The screw 214 is inserted into the opening 226 and the threaded aperture 222 and the screw 215 is inserted into the opening 228 and the threaded aperture 224, securing the upper portion 154 and the lower portion 156 together.

FIGS. 12 to 14 depict an alternative embodiment of a cleat adapter 300. The cleat adapter 300 has an adapter body 302 similar to the adapter body 102 previously described. In the cleat adapter 300, an upper portion 304 and a lower portion 306 connect to define the adapter body 302. The cleat adapter 300 of the present embodiment differs from the cleat adapter 100 described above in the way the upper and lower portions 304, 306 connect to each other. Specifically, a bottom surface 308 of the lower portion 306 includes two circular recessed portions 310, 312. Each circular recessed portion 310, 312 defines an opening 314, 316. Two inner projections 318, 320 extend downwards from an inner surface 322 of the upper portion 304. Each inner projection 318, 320 defines a threaded aperture 324, 326. A threaded aperture 324 aligns with an opening 314 and a threaded aperture 326 aligns with an opening 316. A screw 328 is inserted into the opening 314 and the threaded into the threaded aperture 324 and a screw 329 is inserted into the opening 316 and the threaded aperture 326, securing the upper and lower portions 304, 306 together.

Modifications and improvements to the above-described embodiments of the present invention may become apparent to those skilled in the art. The foregoing description is intended to be exemplary rather than limiting. The scope of the present invention is therefore intended to be limited solely by the appended claims.

What is claimed is:

1. A cleat adapter configured for connecting to a U-shaped tow eye, the cleat adapter comprising:
- a first portion; and
- a second portion connected to the first portion,
- the first portion and the second portion together defining an adapter body,
- the adapter body defining a passage configured to receive a portion of the U-shaped tow eye and to capture the portion of the U-shaped tow eye in the adapter body,
- the adapter body comprising:
  - a first member;
  - a second member;
  - an arm extending between the first member and the second member,
  - the first member, the second member and the arm together defining a generally U shape,
  - the first member, the second member and the arm together defining a space for receiving a tow cord;
  - a first protrusion for retaining a first portion of the tow cord, the first protrusion extending laterally outward from the first member; and
  - a second protrusion for retaining a second portion of the tow cord, the second protrusion extending laterally outward from the second member.

2. The cleat adapter of claim 1, wherein the passage has:
- a first passage portion defined in the first member for receiving a first straight portion of the U-shaped tow eye;
- a second passage portion defined in the second member for receiving a second straight portion of the U-shaped tow eye; and
- a curved passage portion defined by the arm for receiving a curved portion of the U-shaped tow eye,
- the curved passage portion extending between the first passage portion and the second passage portion,
- the curved portion of the U-shaped tow eye extending between the first straight portion of the U-shaped tow eye and the second straight portion of the U-shaped tow eye.

3. The cleat adapter of claim 2, wherein:
- the first portion is an upper portion having:
  - an upper first member;
  - an upper second member;
  - an upper arm;
  - an upper first protrusion; and
  - an upper second protrusion;
- the second portion is a lower portion having:
  - a lower first member;
  - a lower second member;
  - a lower arm;
  - a lower first protrusion; and
  - a lower second protrusion;
- the first member being defined by the upper first member and the lower first member;
- the second member being defined by the upper second member and the lower second member;
- the arm being defined by the upper arm and the lower arm;
- the first protrusion being defined by the upper first protrusion and lower first protrusion;
- the second protrusion being defined by the upper second protrusion and the lower second protrusion; and
- the upper portion and the lower portion being connected to each other for sandwiching the U-shaped tow eye.

4. The cleat adapter of claim 3, wherein:
- the arm is a first arm;
- the upper arm is an upper first arm;
- the lower arm is a lower first arm;
- the adapter body further comprises a second arm spaced apart from the first arm and extending between the first member and the second member;
- the upper portion further comprises an upper second arm;
- the lower portion further comprises a lower second arm;
- the second arm being defined by the upper second arm and the lower second arm; and
- the space is further defined by the second arm.

5. The cleat adapter of claim 4, wherein:
- the upper second arm comprises a projection defining a notch;
- the lower second arm comprises an extension; and
- the notch receives the extension.

6. The cleat adapter of claim 5, wherein:
- the projection is a first projection;
- the notch is a first notch;
- the extension is a first extension;
- the upper second arm further comprises a second projection defining a second notch;
- the lower second arm further comprises a second extension;
- the first projection is disposed at a first end of the upper second arm and the second projection is disposed at a second end of the upper second arm;
- the first extension is disposed at a first end of the lower second arm and the second extension is disposed at a second end of the lower second arm;
- the first notch receives the first extension; and
- the second notch receives the second extension.

7. The cleat adapter of claim 3, wherein:
- the upper first member comprises:
  - an inner first member surface; and
  - a first inner projection extending from the inner first member surface, the first inner projection defining a first channel;
- the lower first member defines a first opening aligned with the first channel; and
- the cleat adapter further comprises a first connector received in the first opening and the first channel for connecting the first portion to the second portion.

8. The cleat adapter of claim 7, wherein:
- the upper second member comprises:
  - an inner second member surface; and a second inner projection extending from the inner second member surface, the second inner projection defining a second channel;

the lower second member defines a second opening aligned with the second channel; and the cleat adapter further comprises a second connector received in the second opening and the second channel for connecting the first portion to the second portion.

9. The cleat adapter of claim 8, wherein:

the lower first member comprises a first recessed portion;

the first opening is defined by the first recessed portion;

the lower second member comprises a second recessed portion; and the second opening is defined by the second recessed portion.

10. The cleat adapter of claim 1, wherein:

the arm is a first arm;

the adapter body further comprises a second arm spaced apart from the first arm and extending between the first member and the second member; and the space is further defined by the second arm.

11. The cleat adapter of claim 1, wherein:

the first protrusion is disposed at an end portion of the first member;

the first protrusion has a first outer face flush with an outer side of the arm;

the second protrusion is disposed at an end portion of the second member; and the second protrusion has a second outer face flush with the outer side of the arm.

12. The cleat adapter of claim 1, wherein the first portion is formed as a first unitary piece and the second portion is formed as a second unitary piece.

13. A watercraft comprising:

a watercraft body;

a U-shaped tow eye connected to and extending rearward from a surface of the watercraft body;

a cleat adapter connected to the U-shaped tow eye, the cleat adapter having:

a first portion; and a second portion connected to the first portion, the first portion and the second portion together defining an adapter body, the adapter body defining a passage receiving a portion of the U-shaped tow eye and capturing the portion of the U-shaped tow eye in the adapter body;

the adapter body comprising:

a first member;

a second member;

an arm extending between the first member and the second member, the first member, the second member, and the arm together defining a generally U shape, the first member, the second member, and the arm together defining a space for receiving a tow cord;

a first protrusion for retaining a first portion of the tow cord, the first protrusion extending laterally outward from the first member; and a second protrusion for retaining a second portion of the tow cord, the second protrusion extending laterally outward from the second member.

14. The watercraft of claim 13, wherein:

the first portion is an upper portion, the upper portion having:

an upper first member;

an upper second member; and an upper arm;

an upper first protrusion; and an upper second protrusion;

the second portion is a lower portion having:

a lower first member;

a lower second member; and a lower arm;

a lower first protrusion; and a lower second protrusion;

the first member being defined by the upper first member and the lower first member;

the second member being defined by the upper second member and the lower second member;

the arm being defined by the upper arm and the lower arm;

the first protrusion being defined by the upper first protrusion and the lower first protrusion;

the second protrusion being defined by the upper second protrusion and the lower second protrusion; and the U-shaped tow eye is disposed in between the upper portion and the lower portion.

15. The watercraft of claim 14, wherein:

the arm is a first arm; and the U-shaped tow eye comprises:

a first straight portion having a first stopper; and a second straight portion having a second stopper;

the adapter body further comprises a second arm abutting the surface of the watercraft body and extending between the first member and the second member, the second arm being disposed forward of the first arm;

the upper portion further comprises an upper second arm defining a first upper semi-circular notch and a second upper semi-circular notch;

the lower portion further comprises a lower second arm defining a first lower semi-circular notch and a second lower semi-circular notch;

the first upper semi-circular notch and the first lower semi-circular notch receives the first stopper;

the second upper semi-circular notch and the second lower semi-circular notch receives the second stopper;

the second arm being defined by the upper second arm and the lower second arm; and the space is further defined by the second arm.

16. A method for attaching a cleat adapter to a U-shaped tow eye, the method comprising:

positioning a first portion of the cleat adapter onto the U-shaped tow eye;

positioning a second portion of the cleat adapter onto the U-shaped tow eye; and connecting the first portion to the second portion to capture the U-shaped tow eye between the first portion and the second portion.

17. The method of claim 16, wherein:

the first portion is an upper portion;

the second portion is a lower portion;

positioning the first portion of the cleat adapter comprises positioning the upper portion on top of the U-shaped tow eye;

positioning the second portion of the cleat adapter comprises positioning the lower portion below the U-shaped tow eye; and connecting the upper portion to the lower portion sandwiches the U-shaped tow eye between the upper portion and the lower portion.

18. The method of claim 17, wherein connecting the upper portion to the lower portion comprises:

inserting a connector into an opening of one of the upper portion and the lower portion; and receiving a portion of the connector into a channel of another one of the upper portion and the lower portion.

19. The method of claim 17, wherein connecting the upper portion to the lower portion comprises:

inserting a first semi-circular protrusion of the lower portion in a first semi-circular notch of the upper portion;

inserting a second semi-circular protrusion of the lower portion in a second semi-circular notch of the upper portion;

inserting a first connector into an opening of the first semi-circular protrusion; and inserting a second connector into an opening of the second semi-circular protrusion.

20. The method of claim 17, wherein connecting the upper portion to the lower portion comprises receiving an extension of one of the upper portion and the lower portion in a notch defined by another one of the upper portion and the lower portion.

* * * * *